US005762519A

United States Patent [19]

Hwang

[11] Patent Number: 5,762,519

[45] Date of Patent: Jun. 9, 1998

[54] C-TYPE LIGHT BULB SOCKET STRUCTURE

[76] Inventor: Min Shien Hwang, No. 2, Lane 65, Chen Kon Road, Hsinchu, Taiwan

[21] Appl. No.: 739,210

[22] Filed: Oct. 29, 1996

[51] Int. Cl.[6] ..... H01R 4/24

[52] U.S. Cl. ..... 439/419; 439/280; 439/602

[58] Field of Search ..... 439/280, 419, 439/587, 602

[56] References Cited

U.S. PATENT DOCUMENTS 5,474,467 12/1995 Chen ..... 439/419
5,660,560 8/1997 Cheng et al. ..... 439/419

FOREIGN PATENT DOCUMENTS 409253 4/1934 United Kingdom ..... 439/602

*Primary Examiner*—J. J. Swann
*Attorney, Agent, or Firm*—Morton J. Rosenberg; David I. Klein; Jun Y. Lee

[57] ABSTRACT

Disclosed in the present invention is an improved C-type light bulb socket structure that comprises soft sealing pads disposed between a socket shell and an end cap to form watertight engagements after these parts being assembled. Therefore, the structure according to the invention has a waterproof interior space in which electrical conductor parts can obtain better protection.

1 Claim, 3 Drawing Sheets

C-TYPE LIGHT BULB SOCKET STRUCTURE

BACKGROUND OF THE INVENTION

In a prior art, the C-type light bulb socket comprises a socket shell accommodating a light bulb on one end and an end cap mounted on the other end, with electrical wires held between the cap and the socket shell and fixed by means of acute ends of the contact plates penetrating through the plastic sheath of the electrical wires. However, in such a socket structure there exists an unavoidable drawback of water leakage that are caused by small gaps formed on the positions where the wires pass through the socket shell. As a result, water can get into the interior of the socket and causes short circuit or malfunction. Furthermore, the negative contact plates in a prior art socket are in close contact with the internal wall surface of the socket so that the distant space between the sharp end of the negative contact plate that pierces into the plastic sheath of wires and the socket wall is small. As the socket is connected to a power source and if water remains on the outer wall surface of the socket, it is possible to have an electrical shock.

Accordingly it is the primary object of the invention to provide a C-type light bulb socket structure in which the above described drawbacks of the prior arts have been removed. Now the features and advantages of the invention will be explained in detail by means of the following description of a preferred embodiment with reference to the accompanying drawings.

BRIEF DESCRIPTION OF THE ACCOMPANYING DRAWINGS

DETAILED DESCRIPTION OF A PREFERRED EMBODIMENT

Figure 1:
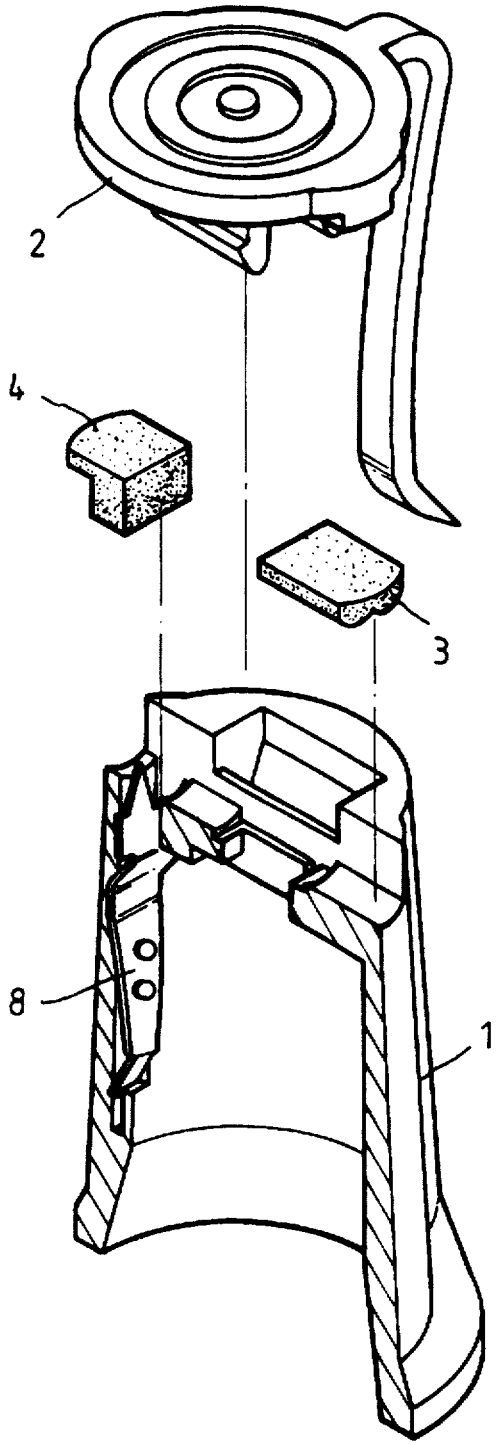
FIG. 1 is a perspective view of a C-type light bulb socket structure according to the invention.
Figure 2:
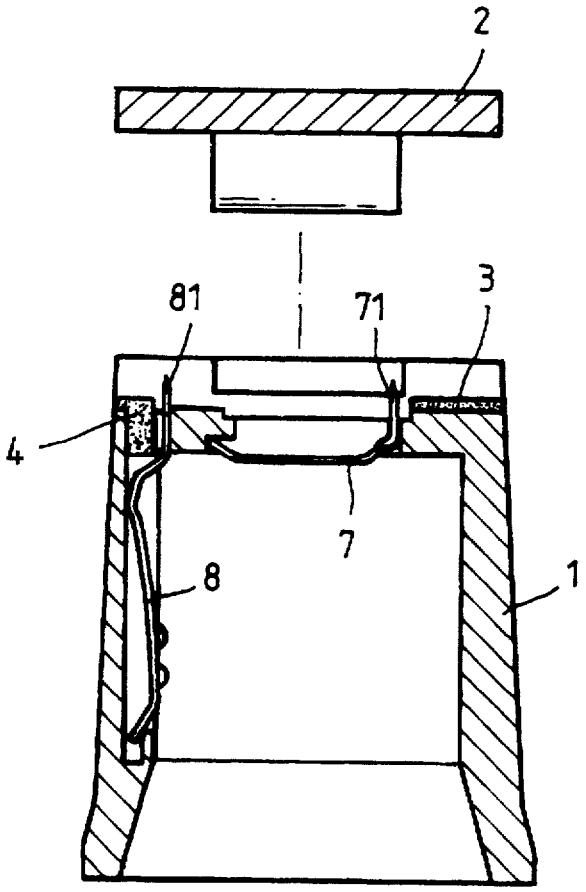
FIG. 2 is a cross-sectional view of the light bulb socket structure of FIG. 1.
Figure 3:
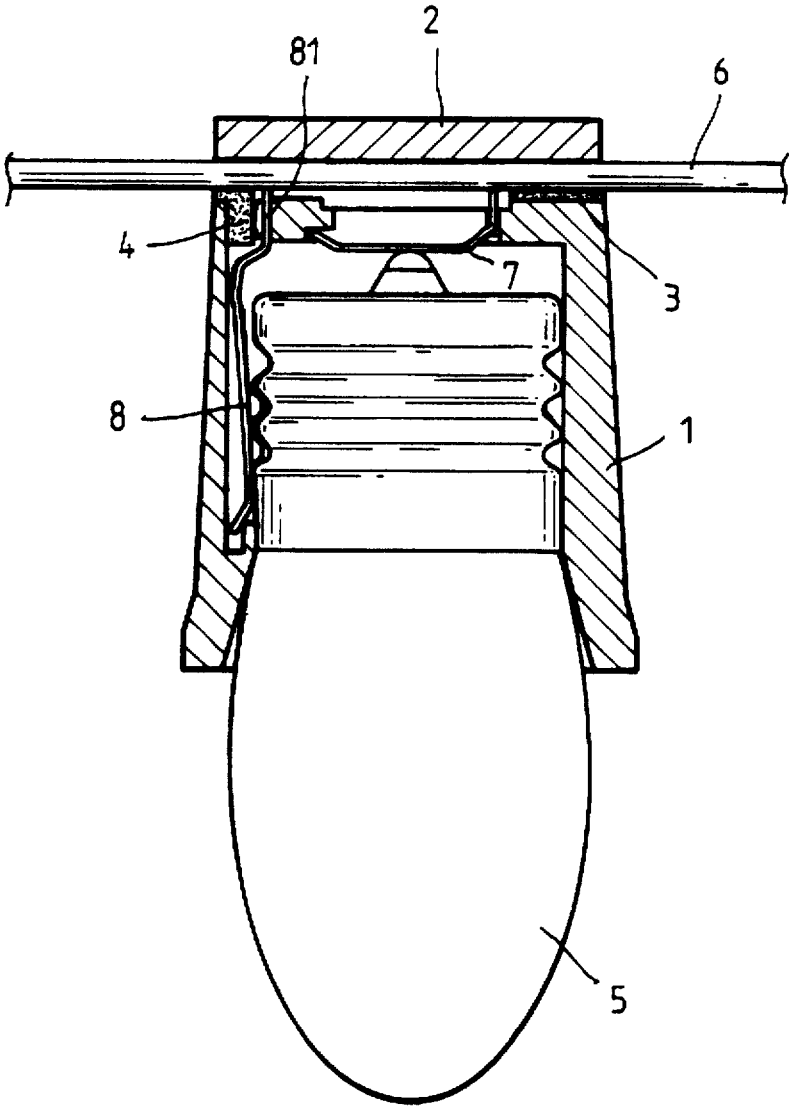
FIG. 3 is a cross sectional view of the light bulb structure of the invention in an assembled state.

Referring to the drawings, in a light bulb socket structure according to the invention, there is a socket shell (1) capable of engaging with an end cap (2) at its top to clamp electrical wires (6) therebetween and receiving a light bulb (5) therein in close contact with negative and positive contact plates (7) and (8). The negative and positive contact plates (7) and (8) pierce through the plastic sheath of electrical wires (6) to conduct electricity with the sharp tips (71) and (81) thereof. The structure of the invention is characterized in that between the end cap (2) and the socket shell (1) there are two soft pads (3) and (4) provided in such a way that the lower portion of the pad (4) is held between the wall of the socket shell (1) and an inwardly bent acute end (81) of the negative contact plate (8) so as to keep the acute end (81) away from the wall of the socket shell (1).

According to the embodiment described above, the end cap (2), electrical wires (6), and the socket shell (1) according to the invention commonly combine to form a watertight engagement due to the soft pads disposed therebetween. Therefore it does not let water in. Besides, the acute end (81) of the negative contact plate (8) is kept apart from the socket wall by the soft pads (4), which can prevent electricity leakage. This is an extra advantage of the invention.

From the description above, the arrangement of soft pads according to the present invention indeed enhances the water proof effect of light bulb sockets and especially an effect of preventing electricity shocks due to the enlarged distance between the sharp end of the contact plate and the socket walls.

What is claimed is:

1. A C-type light bulb structure comprising:

a longitudinally directed socket shell, said socket shell having an open end to receive a light bulb therein and a transversely directed integrally formed back wall disposed at an opposing end thereof, said back wall having a first opening formed therethrough disposed adjacent a side wall of said socket shell, said back wall having a centrally disposed second opening formed therethrough and a transverse channel formed in a rear side thereof and in open communication with said first and second openings for carrying a pair of insulated electrical conductors therein;

a longitudinally directed first electrical contact disposed substantially along a side wall of said socket shell, said contact having a sharpened end portion extending through said first opening in said back wall and into said transverse channel to pierce an insulator of one of the pair of insulated electrical conductors;

a second electrical contact centrally disposed within said socket shell and having a sharpened end portion extending through said second opening and into said transverse channel to pierce an insulator of a second one of the pair of insulated electrical conductors;

a first resilient water sealing pad having a substantially L-shaped body with integrally formed first and second orthogonally directed legs, said first leg being mounted on a surface of said transverse channel adjacent a first end thereof to be overlayed by the pair of insulated electrical wires, said second leg being retained in said first opening in said back wall between said side wall and said first electrical contact for spacing said first electrical from said side wall;

a second resilient water sealing pad being mounted on a surface of said transverse channel adjacent a second end thereof to be overlayed by the pair of insulated wires; and, end cap means being coupled to said back wall of said socket shell for compressively retaining the pair of insulated electrical wires within said transverse channel in watertight engagement with said first and second water sealing pads.

* * * * *